US006692332B2

(12) United States Patent
Jheow

(10) Patent No.: US 6,692,332 B2
(45) Date of Patent: Feb. 17, 2004

(54) TOY FIGURE HAVING PLURALITY OF BODY PARTS JOINED BY BALL AND SOCKET JOINTS

(75) Inventor: Ban Yinh Jheow, Singapore (SG)

(73) Assignee: Stikfas Pte. Ltd., Singapore (SG)

( * ) Notice: Subject to any disclaimer, the term of this patent is extended or adjusted under 35 U.S.C. 154(b) by 0 days.

(21) Appl. No.: 10/113,967

(22) Filed: Mar. 29, 2002

(65) Prior Publication Data

US 2003/0162477 A1 Aug. 28, 2003

Related U.S. Application Data

(60) Provisional application No. 60/359,353, filed on Feb. 25, 2002.

(51) Int. Cl.[7] ..... A63H 3/46
(52) U.S. Cl. ..... 446/383
(58) Field of Search ..... 446/97, 99, 100, 446/101, 102, 120, 375, 383

(56) References Cited

U.S. PATENT DOCUMENTS

| | | | |
|---|---|---|---|
| 2,752,726 | A | 7/1956 | Calverley |
| 4,205,482 | A | 6/1980 | Christiansen et al. |
| 4,274,224 | A | 6/1981 | Pugh et al. |
| 4,669,998 | A | 6/1987 | Amici et al. |
| 4,680,019 | A | 7/1987 | Baerenwald et al. |
| 4,790,789 | A | 12/1988 | Mathis |
| 4,992,069 | A | 2/1991 | Bolli et al. |
| 5,044,960 | A | 9/1991 | De Porteous |
| 5,380,233 | A | 1/1995 | Numoto |
| 5,752,869 | A | 5/1998 | Huff |
| 5,913,706 | A | 6/1999 | Glickman et al. |
| 6,033,284 | A | 3/2000 | Ferre |
| 6,089,950 | A | 7/2000 | Lee et al. |
| 6,273,247 | B1 | 8/2001 | Harada et al. |
| 6,287,166 | B1 | 9/2001 | Lee et al. |

FOREIGN PATENT DOCUMENTS

| | | |
|---|---|---|
| EP | 0709173 | 5/1996 |
| JP | 2001096073 | 4/2001 |
| SG | 96038039 | 8/2001 |
| WO | WO 0138050 | 5/2001 |
| WO | WO 0162448 | 8/2001 |

*Primary Examiner*—Jacob K. Ackun
(74) *Attorney, Agent, or Firm*—Paul & Paul

(57) ABSTRACT

An articulated toy figure 1000 comprising a plurality of body parts each operatively adapted to be adjoined one to another by a ball-socket joint arrangement 25, each ball-socket joint arrangement 25 having a ball portion 10 protruding from a region of a body part and also having a corresponding socket portion 15 located in an adjoining body part. The ball portion 10 having a knob 20 supported on a shaft 30, the socket portion 15 having a socket 40 which rotatably receives the knob 20, wherein, in one or more of the ball-socket joint arrangements 25, the socket portion 15 is provided with a contoured cavity arrangement 50 having the socket 40 in its interior, the contoured cavity arrangement 50 limiting the extent of movement of the shaft 30 therewithin.

23 Claims, 12 Drawing Sheets

FIG. 2A
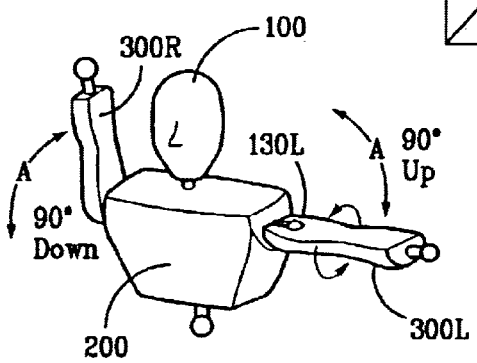
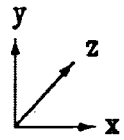
FIG. 2B
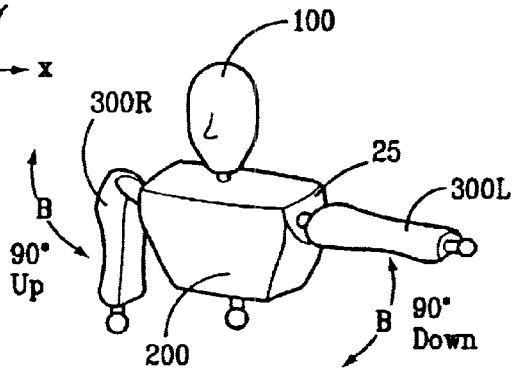
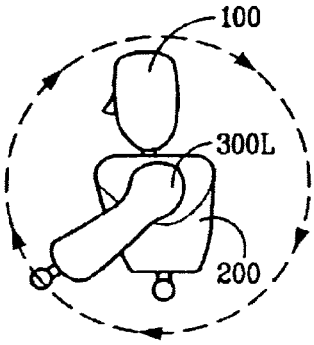
FIG. 2C
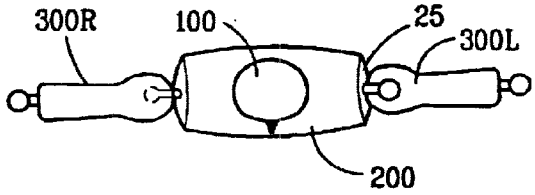
FIG. 2D FIG. 3A
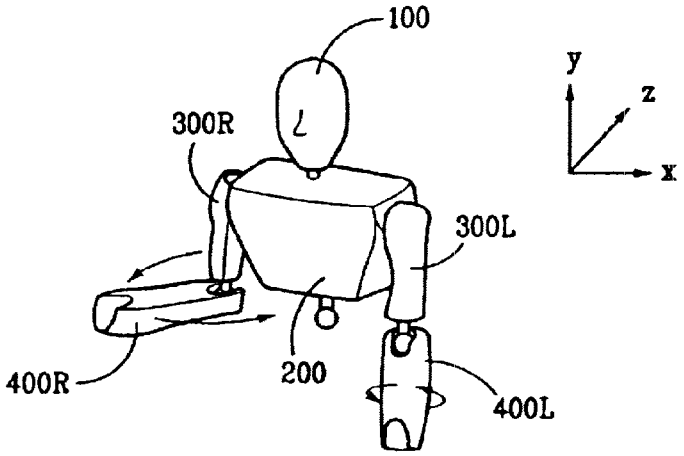
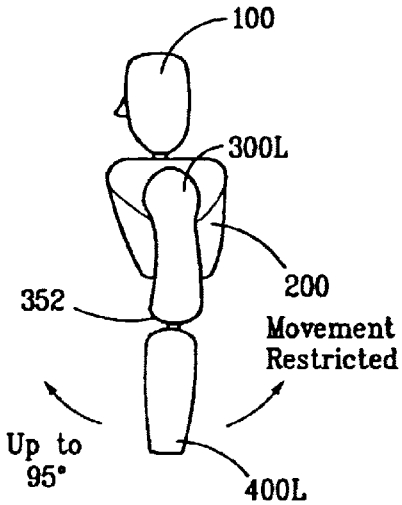
FIG. 3B
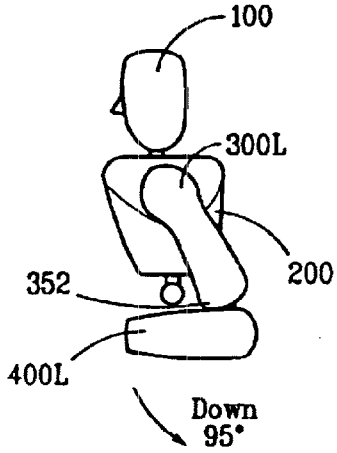
FIG. 3C FIG. 4A
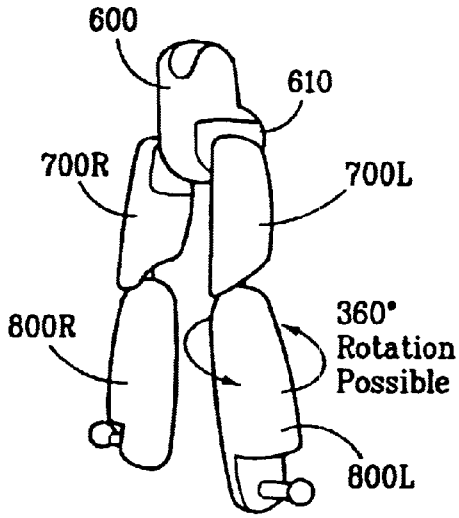
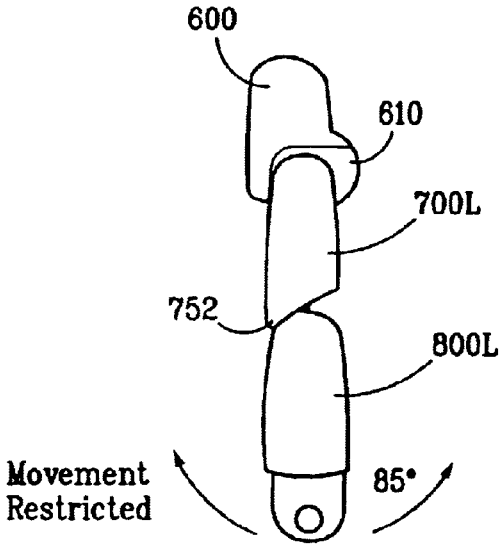
FIG. 4B
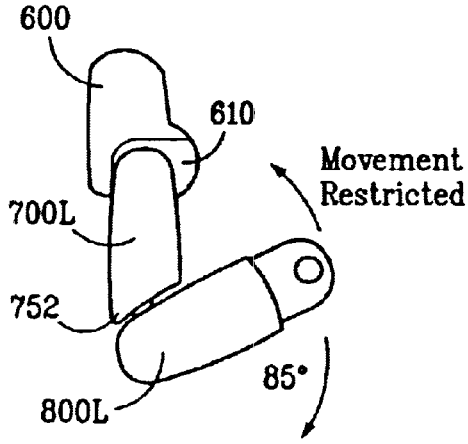
FIG. 4C FIG. 5A
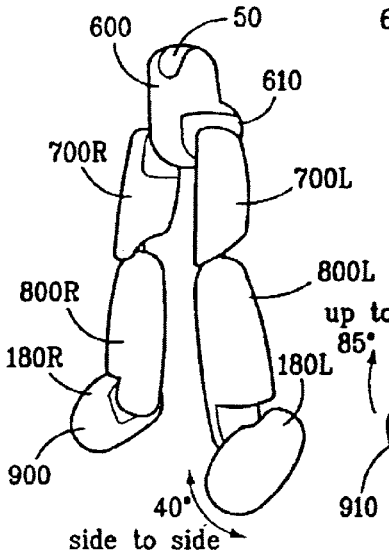
FIG. 5B
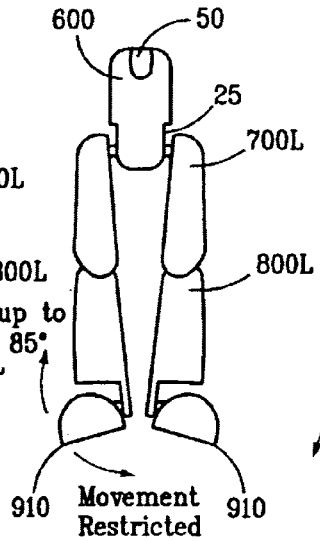
FIG. 5C
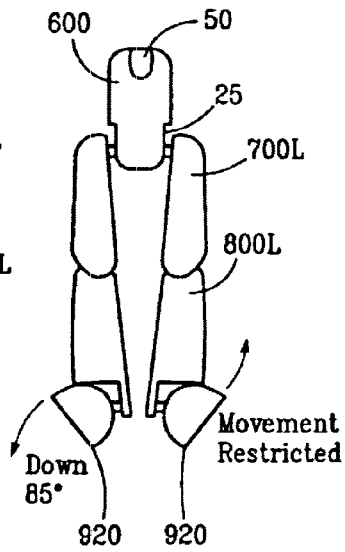
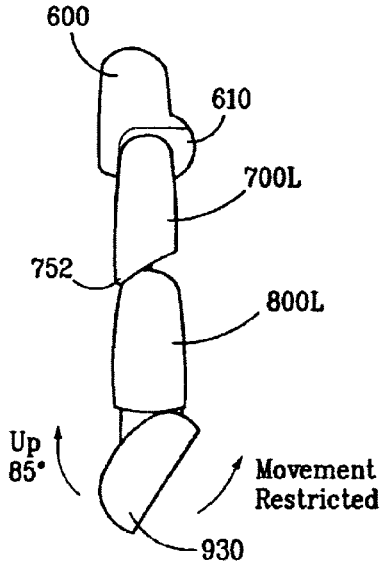
FIG. 5D
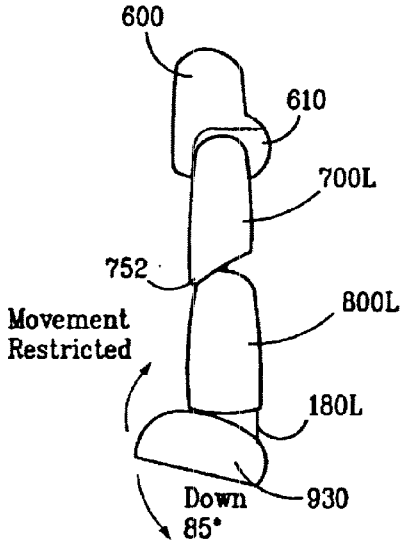
FIG. 5E FIG. 10A
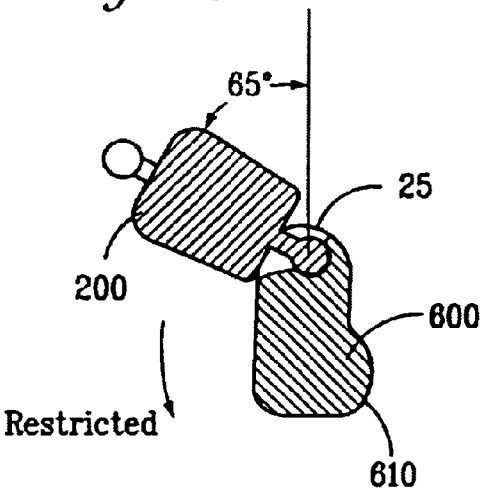
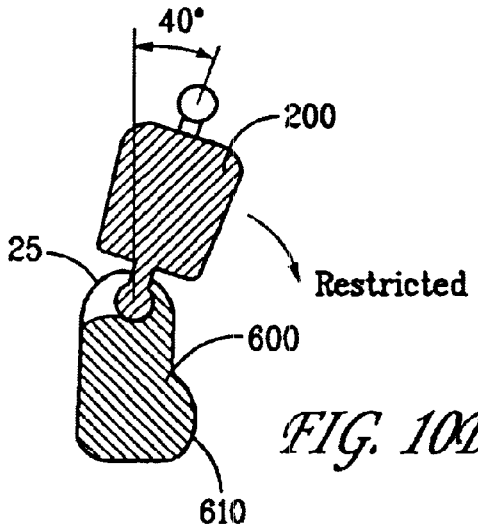
FIG. 10B
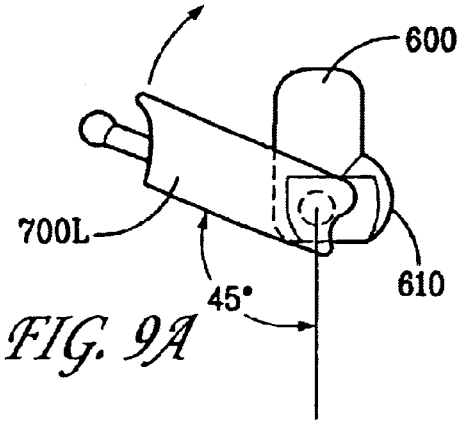
FIG. 9A
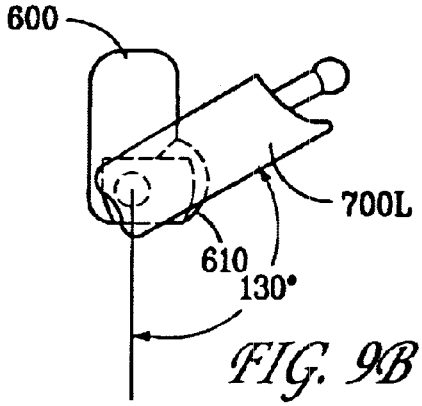
FIG. 9B
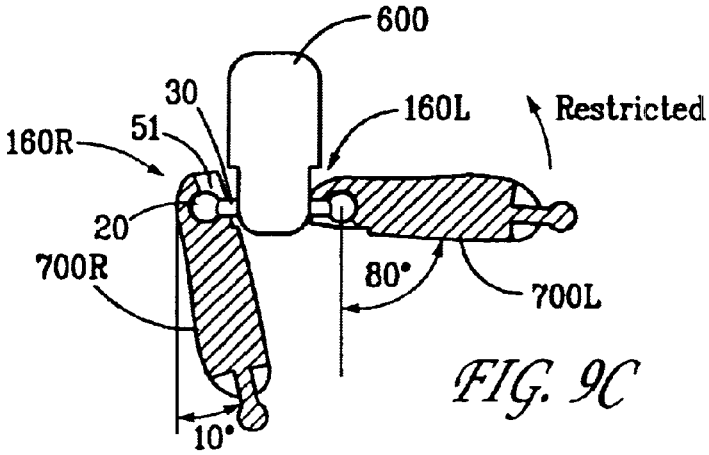
FIG. 9C FIG. 11A
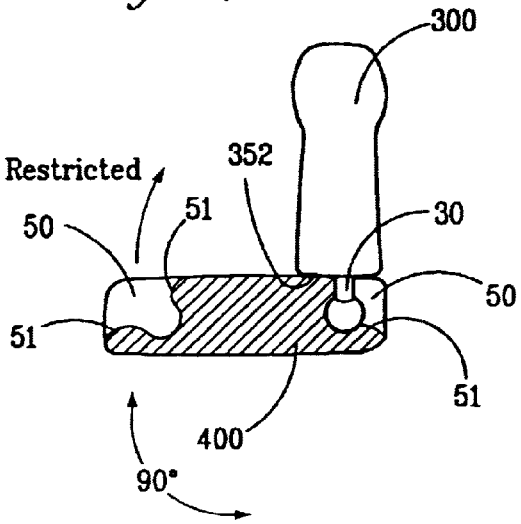
FIG. 11B
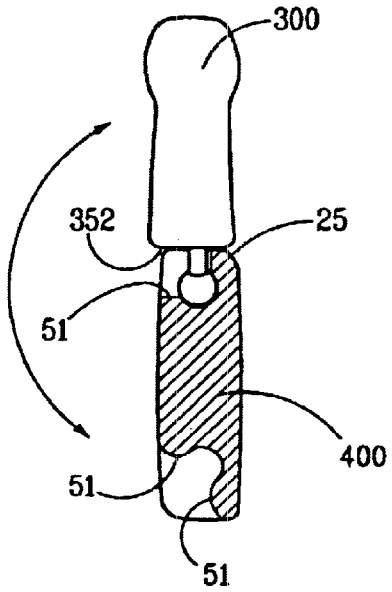
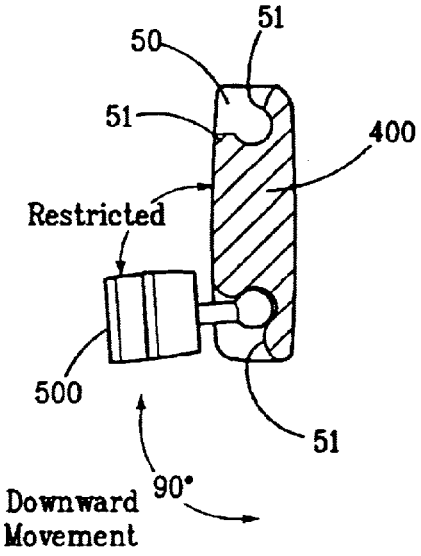
FIG. 11C
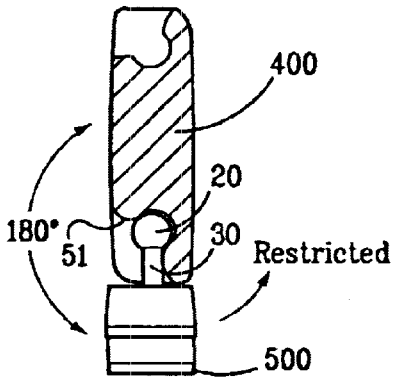
FIG. 11D FIG. 12A
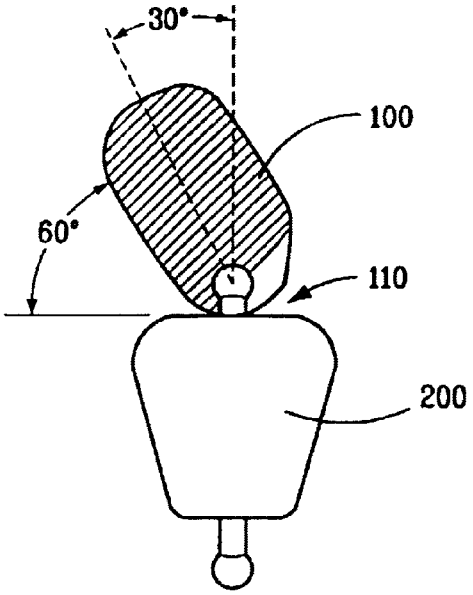
FIG. 12B
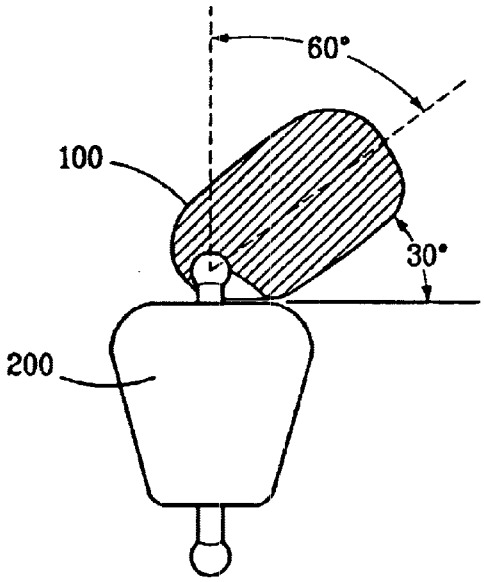
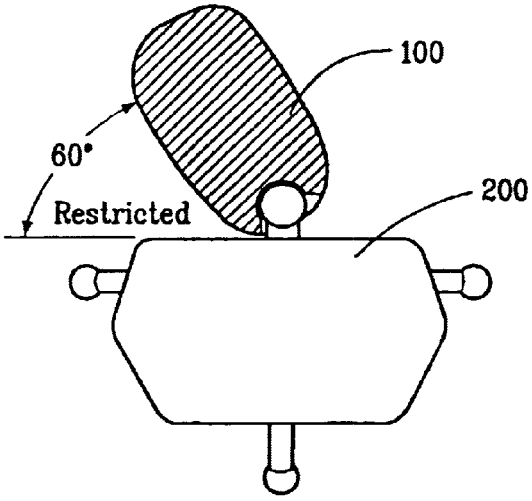
FIG. 12C
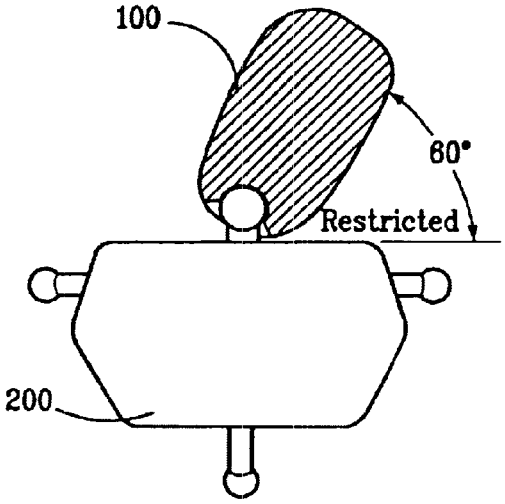
FIG. 12D

TOY FIGURE HAVING PLURALITY OF BODY PARTS JOINED BY BALL AND SOCKET JOINTS

This application claims the benefit of Provisional Application No. 60/359,353, filed Feb. 25, 2002.

FIELD OF THE INVENTION

This invention relates to toy figures having a plurality of body parts each adjoined one to another by ball and socket joints.

BACKGROUND OF THE INVENTION

Toy figures aim to replicate the posture and movement of the corresponding live figures. For instance, a human-like toy figure attempts to replicate as far as possible the movements of the human body.

As toy figures decrease in size, it becomes more difficult to design and manufacture the toy figures incorporating multiple movable joints.

A particular problem, for such small toy figures, is the need to provide small joints that are durable have sufficiently close tolerances to provide the necessary friction between the moveable surfaces of the joints required for proper operation of the joints.

As the number of joints increases, the problem is compounded because the competing need for strength in the joints generally points to larger limb members, whereas compactness is often a desired goal in small toy figures.

The present invention proposes improvements particularly to the joint arrangements used in such miniaturized toy figures.

The invention is restricted to the field of toy figures, and in particular addresses problems associated with miniature toy figures which are, for example, around or slightly larger than three inches high.

SUMMARY OF THE INVENTION

According to the present invention, there is provided an articulated toy figure comprising a plurality of body parts each operatively adapted to be adjoined one to another by a ball-socket joint arrangement, each ball-socket joint arrangement having a ball portion protruding from a region of a body part and also having a corresponding socket portion located in an adjoining body part, the ball portion having a knob supported on a shaft, the socket portion having a socket which rotatably receives the knob, wherein, in one or more of the ball-socket joint arrangements, the socket portion is provided with a contoured cavity arrangement having the socket in its interior, the contoured cavity arrangement limiting the extent of movement of the shaft therewithin.

In one preferred embodiment of the invention, for one or more of the ball-socket joint arrangements, a rotation-guard is provided proximate the region of the body part from which the ball portion protrudes, the rotation-guard also limiting the extent of movement of the shaft within the contoured cavity arrangement, each contoured cavity arrangement and rotation-guard, individually or in combination, enabling the ball-socket joint arrangement to largely replicate the movement of such a joint in a corresponding live figure.

Preferably, the rotation-guard comprises a protrusion of the body part from which the ball portion protrudes, the protrusion hindering the rotation of the adjoining body part.

Preferably, the rotation-guard is integral and formed of the same material as the body part from which it protrudes.

Preferably, the rotation-guard comprises a protrusion that protrudes from the body part generally in the direction of the longitudinal axis of the shaft.

Preferably, one of the rotation guards is located at a joint which corresponds to a knee.

One of the rotation guards may be located at a joint which corresponds to an ankle.

Preferably, the contoured cavity arrangement includes contoured side walls which define the extent of movement of the shaft therewithin, the shaft being adapted to rotate within the confines of the side walls of the cavity arrangement.

In one or more of the ball-socket joint arrangements, the side walls may be non-symmetrical.

In an exemplary embodiment of the invention, the side walls of the contoured cavity arrangement define an opening leading to the socket, the opening allowing movement of the stem therein with a greater degree of freedom of movement in generally a first direction than in a second direction which is transverse to the first direction.

Preferably, the knob is detachably connectable to the corresponding socket portion.

Preferably, in the ball portion, the ratio of the ball diameter to the shaft diameter is around 1.36.

Preferably, the toy figure when standing upright is around three inches high.

Preferably, the toy figure when standing upright is at least three inches high.

In an embodiment of the invention, the ball diameter is 0.05 to 0.08 mm larger than the socket diameter to provide interference suitable for achieving longevity of stability in the articulations.

Preferably, each of the legs of the toy figure has a lower and an upper limb, the lower limb being larger than the upper limb to enable to the center of gravity to be positioned closed to the lower portion of the overall leg.

Preferably, each of the arms of the toy figure has a lower and upper limb, the lower limb being larger than the upper limb to enable to the center of gravity to be positioned closed to the lower portion of the overall arm.

Preferably, the ankle of the toy figure has a ball portion wherein the stem is arranged substantially perpendicular to the longitudinal axis of the lower leg body part.

Preferably, the ball portion protruding from the ankle is connected to the side of a body part corresponding to a foot.

Preferably, the toy figure is provided with ball-socket joint arrangements in the ankle, knees, hips, torso, shoulders, elbows and neck.

Preferably, the toy figure is provided with ball-socket joint arrangements in all of its joints, preferably numbering fourteen in total.

Preferably, the weight of the leg portions of the toy figure are substantially the same as the remaining parts of the figure to achieve a degree of balanceability of the toy.

In an embodiment of the invention, in one or more of the ball-socket joint arrangements, the socket is located at one end of an elongated body part, the socket portion being adapted to receive the knob into the socket through an opening in a lateral side of the elongated body part.

Preferably, the toy is human-like or animal-like.

According to another aspect of the invention, there is provided a ball-socket joint arrangement operatively adapted to join a plurality of body parts to form an articulated toy figure, the ball-socket joint arrangement having a ball portion protruding from a region of a body part and also having a corresponding socket portion located in an adjoining body part, the ball portion having a knob supported on a shaft, the socket portion having a socket which rotatably receives the knob, wherein, in one or more of the ball-socket joint arrangements, the socket portion is provided with a contoured cavity arrangement having the socket in its interior, the contoured cavity arrangement limiting the extent of movement of the stem therewithin.

According to a further aspect of the invention, there is provided an ankle socket as described above in the context of the toy figure.

DRAWINGS

In order that the present invention might be more fully understood, embodiments of the invention will be described, by way of example only, with reference to the accompanying drawings, in which:

FIGS. 2A to 2D illustrate the range of movement possible in the upper arms of the toy figure of FIG. 1;

FIGS. 3A to 3C illustrate the range of movements possible for the lower forearms of the same toy figure of FIG. 1;

FIGS. 4A to 4C illustrates the range of movement possible for the knee joints of the same toy figure;

FIGS. 5A to 5E illustrate the range of movements possible for the ankle joints of the same toy figure of FIG. 1;

Figure 1:
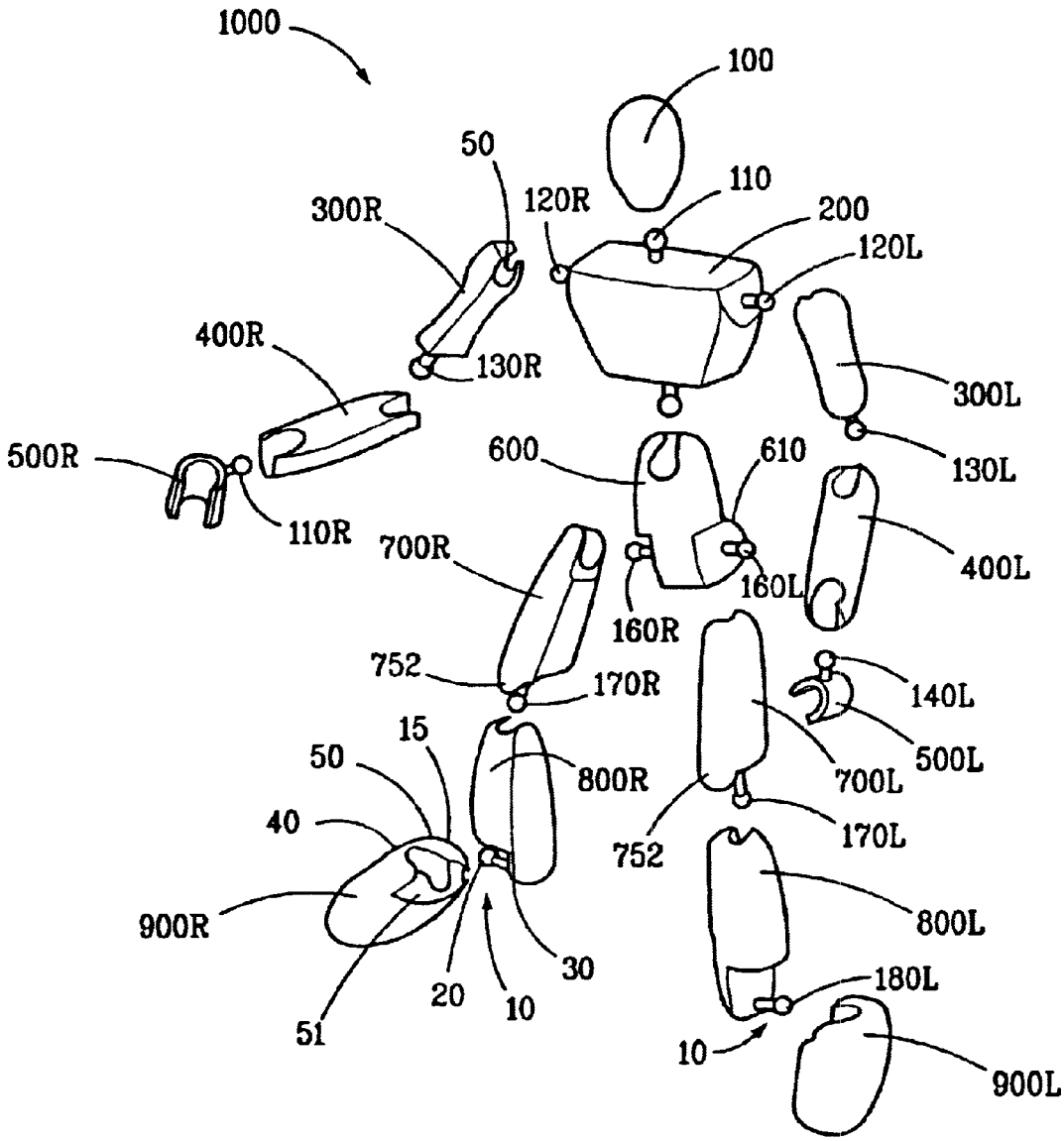
FIG. 1 illustrates an exploded perspective view of a plurality of body parts adjoined together to form an articulated toy figure in accordance with an embodiment of the invention.
Figure 7A:
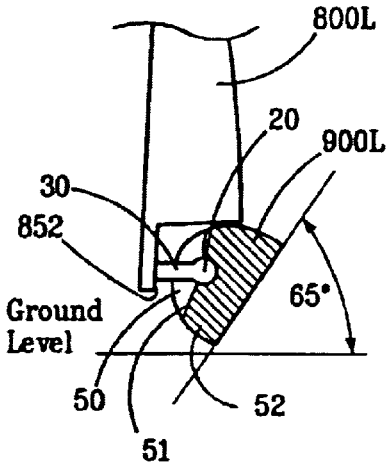
Figure 7B:
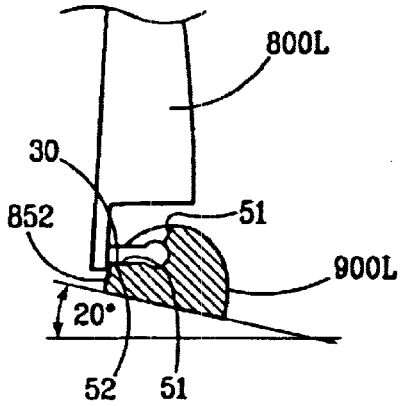
Figure 7C:
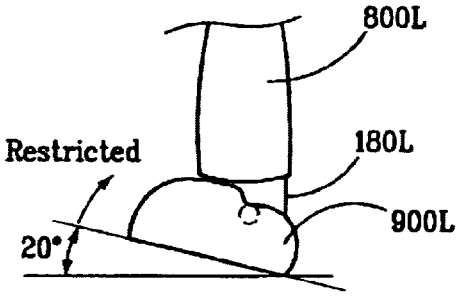
Figure 7D:
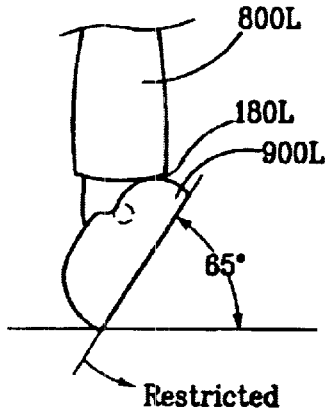
Figure 7E:
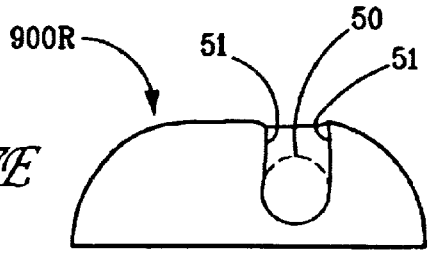
Figure 8A:
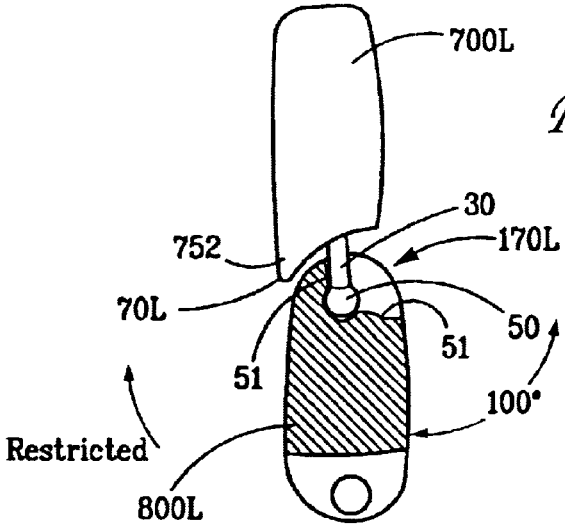
Figure 8B:
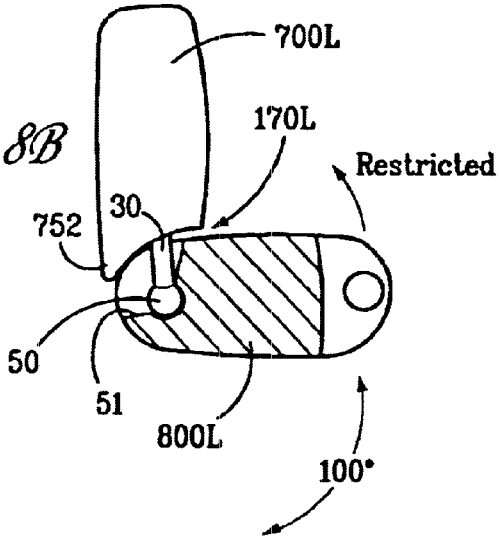
Figure 8C:
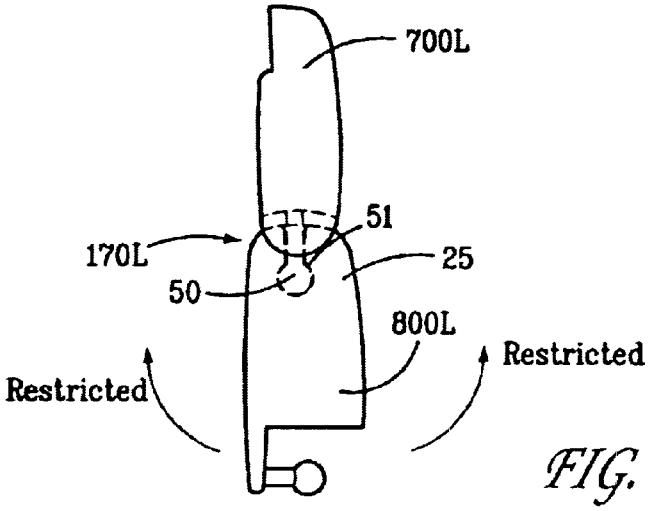
Figure 10C:
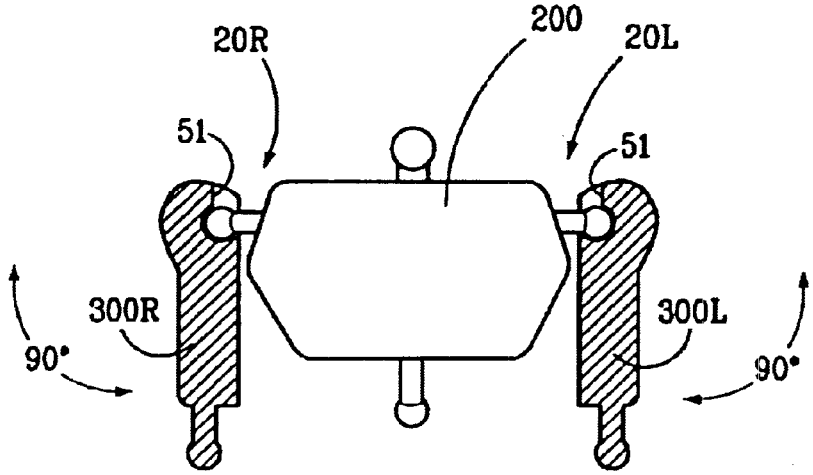

FIGS. 7A and B are cross-sectional views of the ankle joint of the toy figure of FIG. 1, while FIGS. 7C to 7E are side views of the feet of the toy figure;

FIGS. 8A and B show the extremes of movement possible for the knee joint of the toy figure of FIG. 1;

FIG. 8C shows a front cross-sectional view of the knee joint of FIGS. 8A and B;

FIGS. 9A to C illustrate side and front views of the hip joints of the toy figure, with FIG. 9C being a cross-sectional view;

FIG. 10A is a cross-sectional view which illustrates the range of movement possible for the torso joint of the toy figure;

FIGS. 10B and 10C are cross-sectional views which illustrate a range of movement possible for the shoulder joints of the toy figure;

FIGS. 11A and B illustrate cross-sectional views of the range of movement possible in the forearm of the toy figure;

FIGS. 11C to 11D illustrate the range of movement possible in the wrist joint of the toy figure; and FIGS. 12A to 12D illustrate the range of movements possible in the neck joint of the toy figure.

In the drawings, some of the components share common reference numerals, such as common reference numeral for the ball, shaft, side walls and contoured cavities, but it is understood that the dimensions and shapes of each joint varies with each joint. The common reference numerals are merely for the sake of ease of understanding the description.

DESCRIPTION OF EMBODIMENTS

Referring to the drawings, FIG. 1 illustrates an exploded perspective view of various components of an embodiment of an articulated toy figure 1000. In this example, the toy figure represents a human.

The toy figure 1000 comprises a plurality of body parts, each operatively adapted to be adjoined one to another by a ball-socket joint arrangement 25. Seamless articulation is provided by the use of ball and socket joint arrangements 25 for each joint of the toy figure 1000.

The embodiment of the toy figure 1000 is able to simulate the extent of movement or articulation to a corresponding live form that the toy figure 1000 seeks to represents. These life forms may include human figures, dinosaur, robotic creatures or mythical creatures. To simulate life-like limb articulations, the embodiment of the toy figure 1000 has a large number of joints sufficient to emulate that of a life form. In the embodiment, the toy figure 1000 has at least fourteen ball-socket joints 25. The fourteen joints are found at the neck 110, shoulders 120L, 120R, elbows 130L, 130R, wrist 140R, 140L, upper torso 150, lower torso or hips 160R, 160L, knees 170R, 170L, and ankles 180R, 180L. (The letters L and R refer to left and right orientation).

When using such a large number of joints in a toy figure 1000 of such small size, a balance is required. On one hand, the need to achieve a structurally rigid figure with limbs large enough to contain socket joints within the limb members points to the need for larger joints. On the other hand, the opposing limitation is to keep the limb dimensions within the bounds of life-likeness.

The embodiment of the toy figure 1000 is around three inches high, and overcomes problems associated with creating an articulated life-like toy figure of this size.

In FIG. 1, the toy figure 1000 comprises a head 100, an upper torso 200, a lower torso 600 having a rear end 610, upper arms 300L, 300R, lower forearms 400L, 400R, hands 500L, 500R, upper legs or thighs 700L, 700R, lower legs or calves 800L, 800R and feet 900L, 900R.

In the embodiment, all of the joints are made up of ball-socket joints 25. Each ball-socket joint arrangement has a ball portion 10. In the embodiment, all of the ball portions of the toy figure 1000 are identical to enable interchangeability of the various body parts, if desired by the user.

The ball portion 10 comprises a knob or ball 20 supported on a stem or shaft 30. The ball 20 and shaft 30 of each of the ball portions is best seen in some of the cross-sectional views in FIG. 7 onwards.

Each ball-socket joint arrangement 25 has a ball portion 10 which protrudes from a region of one of the body parts. The ball-socket joint arrangement 25 also has a corresponding socket portion 15 which is located in an adjoining body part. The ball portion 10 and the socket portion 15 connect together in a ball-socket manner to provide the adjoining parts with varying degrees of relative rotational movement.

The socket portion 15 has a socket 40 which receives the ball 20. The ball 20 is detachably connected to the socket 40.

In one or more of the ball-socket joint arrangements, the socket portion 15 is provided with a contoured cavity arrangement 50 having the socket 40 in its interior. The contoured cavity arrangement 50 limits the extent of movement of the shaft 30 within the cavity 50. The inner shape of examples of contoured cavity arrangements of different joints are best seen in some of the cross-sectional views in FIG. 7 onwards.

This limitation of movement is achieved because the contoured cavity 50 has side walls 51 which define the extent of movement for the shaft 30 within the cavity 50.

In one or more of the socket arrangements, the side walls 51 of the contoured cavity arrangement 50 define an opening leading to the socket 40. The opening allows movement of the shaft 30 therein with a greater degree of freedom of movement in generally a first direction than in a second direction which is transverse to the first direction. For instance, in FIGS. 8A and 8B, the opening allows a greater degree of movement in a general vertical plane, whereas there is considerably less freedom to move side to side.

Throughout the drawings, the side walls are numbered as 51 merely for the sake of ease of understanding, however, it is appreciated that each of the contours of the cavities 50 in the various joints of the toy are different. The difference in each contoured cavity 50 of each joint is necessary so as to provide a different range of movement in order to simulate the variety of movement found in the human body.

In one or more of the body parts in the embodiment, the socket 40 is located at one end of an elongated body part. The socket portion 15 is adapted to receive the ball 20 into the socket 40 through an opening in a lateral side of the elongated body part, rather than entering the socket 40 in a direction which is in line with the axis of the elongated body part. However, in other modifications, the ball 20 can be made to enter the socket 40 in a direction which is in line with the axis of the elongated body part, provided the designer is convinced that such a modification would be beneficial to achieve either a greater degree of realism, flexibility, balanceability, or other such benefits including those mentioned in this specification.

FIGS. 2 to 5 show examples of the range of possible movement which simulate human-likeness because of the shape of the contoured cavities 50.

FIGS. 2A to 2D Illustrate the range of movements which are possible for the upper arms 300L, 300R of the toy figure 1000.

In FIG. 2A, the opening of the contoured cavity 50 is oriented upwards (shown at the shoulder of upper arm 300L) which enables the upper arm 300 to have a range of movement of 90° in the x-y plane (as shown by the curved arrow A shown in relation to right upper arm 300R).

When the upper arm 300L is rotated 180°, about the shoulder joint 120L as shown in FIG. 2B, the opening of the contoured cavity 50 now faces downwards which enables the upper arm 300R, 300L to move up and down through a range of movement of 90° in the x-y plane, as shown by arrow B in FIG. 2B.

The shape of the contoured cavity 50 also enables the upper arms 300 to rotate around a range of 360° about the shoulder joint 120 in the y-z plane, as shown in the side view of FIG. 2C (similar to a person rotating their arms like a windmill).

In the plan drawing of FIG. 2D, the opening of the contoured cavity 50 is oriented upwards for left upper arm 300L and oriented downward for right upper arm 300R. This means that the left arm 300L can move from horizontal to upright in the x-y plane, while the right arm 300R can move from horizontal down to alongside the body also in the x-y plane (similar to the manner shown in FIGS. 2A and 2B). However, in this orientation, the arms 300 cannot rotate forwards in the x-z plane. In order to move the arms 300 forwards in the x-z plane, the openings of the contoured cavity 50 would have to be rotated on shoulder joint 120 to face forwards.

FIGS. 3A to 3C illustrate how the shape of the contoured cavities 50 enable a variety of movements in the forearms 400L. Each contoured cavity 50 has a socket 40 in its interior. This enables 360° axial rotation in the x-z plane, such as seen in the left forearm 400L in FIG. 3A.

In the embodiment, the forearm member 400 is the only body part to contain two socket portions 15, hence the forearms 400 are designed to be thicker than the upper arms 300 to maintain structural strength around the elbow and wrist sockets 130 and 140.

In FIG. 3A, the socket 40 in the contoured cavity 50 also enables 360° rotation in the x-z plane, such as in the right forearm 400R. Of course, such movement includes a portion which is unrealistic, but a slight compromise in departing from reality is acceptable so that the components of the toy figure 1000 do not become too bulky, which would happen if various stops or extra components were to be added to avoid all unhuman-like movement.

As seen in the right forearm 400L in FIG. 3A, the opening of the contoured cavity 50 is oriented on the front-facing part of the elbow joint 130L. Specifically, the rear-facing portion of the elbow joint 130L is not provided with an opening. In other words, the contoured cavity 50 of the elbow joint 130L has side walls 51 which are closed at the back end while being open at the front-facing end. This arrangement enables the forearm 400L to move up and down in the x-y plane as shown in FIG. 3C, but not rearwards which would be unrealistic.

The shape of the contoured cavities 50 is unique for each joint in the toy figure 1000, since it is intended to simulate, as closely as possible, the range and limitation of human movement. In particular, the variation in each contoured cavity 50 is achieved by varying the location of openings in the side walls 51. For instance, in FIGS. 11A and 11B, an opening in a side wall 51 enables the shaft 30 to move in the opening. Thus, in FIG. 11A, the biasing of the opening enables the forearm 400 to move forward, but not rearward (comparing FIGS. 11A and 11B). The openings in the sides of the contoured cavities 50 are the result of the absence of such side walls 51 in those parts of the cavity 50.

In FIG. 12, biasing of the contoured cavity 50 is apparent as it allows movement in the x-y plane of 30° from the vertical axis on both sides of the axis (as seen in FIGS. 12A, 12B and 12C), and 60° both sides from the vertical axis in the y-z plane.

Thus, in one or more of the ball-socket joint arrangements 25, the side walls 51 of the contoured cavities 50 are not symmetrical, since the openings in the side walls will vary in order to simulate the range of human movement. Moreover, the angle or inclination of the side walls 51 of the contoured cavities 50 will also vary to achieve larger or smaller openings.

Having non-symmetrical openings in the sides of the contoured cavities 50 limits the movement of one of the limbs with a bias towards one direction over another. For example, in FIGS. 11A and 11B, there is a bias towards forward movement of the forearm 400, since this simulates the action of a human forearm.

It is desirable, sometimes, to compromise the level of realism, particularly where achieving 100% realism would be detrimental to the compactness of the toy. Hence, for each joint, a decision must be made as to what degree of realism is required to retain the overall compactness of the toy figure 1000.

The shape of the contoured cavities 50 of each joint should at least enable a user to arrange the various body parts into an overall configuration which can simulate the human body. In other words, it is not necessary that the toy figure 1000 be blocked from all unnatural position, but merely that it be capable of achieving all natural positions.

As seen in FIG. 3, the forearms 400 are larger than the upper arms 300. This is to enable the center of gravity of the arm to be located closer to the lower part of the arm. This exaggerated size of the lower part of the arm, for providing a lower center of gravity, is also seen in the leg portions of the toy figure 1000. In FIG. 5, the lower leg portions 800 are larger than the upper leg portions 700. The lower location of the center of gravity provides the toy figure 1000 with a greater degree of stability when standing.

Furthermore, to enhance stability, the feet 900 are also oversized. Thus, as seen in FIG. 5, there is an increase in the size of limbs and body parts leading towards the bottom of the toy figure 1000. This gradual limb-size increase towards the bottom of the toy provides a lower center of gravity which enhances stability in the standing position of the toy figure 1000.

FIG. 11A shows a cross-sectional view of the contoured cavities 50 of the lower forearm 400.

FIGS. 11A and 11B show how the shape of the contoured cavities 50 influence the extremes of the range of movement afforded by the ball-socket joint 25 about the elbow joint 130. In FIGS. 11A and 11B, the side walls 51 of the contoured cavity 50 limit the range of movement of the shaft 30 within the contoured cavity 50. The movement of the shaft 30 within the contoured cavity 50 defines the range of movement of the lower forearm 400.

FIGS. 11C to 11D show how the side walls 51 of the contoured cavity 50 of the wrist joints 140 define the range of possible movements for the hand 500 with respect to the lower forearm 400.

FIGS. 4, 5, 7, 8 and 9A to C illustrate examples of the range of possible movements of the legs and feet 700, 800, 900. Once again, in the ankle 70 and knee joints 170 and 180, it is the shape of the side walls 51 of contoured cavities 50 which determine and limit the range of movements of the shafts 30 of the ball portions 20 of the joints.

Feet and Ankle Joints

As seen in FIGS. 5A to E and FIGS. 7A to E, the ankle joints 180 provide the feet 900 with a range of realistic movements.

In FIGS. 7A and 7B, it is important that the shaft 30 of the ankle joint 180 is arranged substantially or exactly perpendicular to the longitudinal axis of the lower leg 900.

The importance can be appreciated by understanding the disadvantages that result if the shaft 30 were to point downwards in line with the longitudinal axis of the leg 800, as found in the prior art. Here, the extreme rotation of FIG. 5D would not be as readily achieved. Therefore, toy figures in the prior art which have the shafts of the ankle joints pointing vertically downwards (rather than perpendicular) cannot achieve a prone or kneeling position which requires the extreme pointing of the feet 900 as in FIGS. 5D and 7D.

Another advantage of the perpendicular orientation of the shaft 30 at the ankle joint 180 of the present embodiment is that it increases the stability of the toy figure 1000. When the toy figure 1000 is standing astride with the feet 900 slightly parted, it is evident from FIG. 7B that the shaft 30 rests on or is close to the lower side wall 51. Thus, when the toy figure 1000 stands, the perpendicular shaft 30 in FIG. 7B is at or is close to its limit of rotation. In contrast, when the ankle shaft in the prior art is arranged vertically (rather than perpendicularly) the shaft has a considerable range of movement all around when the toy figure stands. Thus, when such prior art toy figures stand, there is greater potential of movement in the ankle joints compared to the ankle joint 180 of the present embodiment. Thus, the present embodiment is inherently more stable in its ankle joints 180 than prior art inventions in which the ankle shafts are arranged in line with the longitudinal axis of the lower leg 800.

Rotation Guards

For one or more of the ball-socket joint arrangements 25, a rotation-guard is provided. In the embodiment, the rotation-guard performs a similar function to the contoured cavity 50 by limiting the extent of movement of the shaft 30. An example of a rotation-guard is seen in the overhanging portion 752 for instance in FIGS. 1, 4B, 4C and FIGS. 8A and 8B.

In FIGS. 8A and 8B, it is evident that the side walls 51 of the contoured cavity 50 define the extremes of rotational movement of the shaft 30 within the cavity 50. The cross-sectional views of FIGS. 8A and 8B show that the side walls 51 define a range of movement of around 100° in roughly a vertical plane. However, the cross-sectional front view of FIG. 8C shows that the width or distance between the side walls 51 provide a narrower rear-facing opening. This narrower rear opening limits the side to side movement of the lower leg 800L. This simulates a human lower leg which has considerable freedom of rearwards movement in a vertical plane, but significantly less side to side movement.

In addition to the freedom of movement of the shaft 30 being limited by the side walls 51, the movement of the shaft 30 is also limited by the rotation guards in the form of the overhanging portion 752. As seen in FIG. 8A, when the shaft 30 abuts the upright inner wall 51, the projecting portion 752 on the upper leg 700L also abuts an upper surface of the lower leg 800L. Thus, the projection 752 works in combination with the upright side wall 51 to limit the forward rotational movement of the knee joint 170L shown in FIG. 8.

This sharing of the load between the rotation guards in the form of the projection 752 on the upper leg 700L, and the upright inner side wall 51 of the lower leg 800L, allows the stress in the knee joint 170L to be shared, rather than carried by one. If not for the presence of the rotation guards in the form of the projection 752, the entire stress or load would be carried by the shaft 30.

The rotation guard in the form of projection 752 is provided proximate the region of the upper leg 700 from which the ball portion 10 protrudes.

In the knee joint 170 in FIG. 8, it is the combination of the projection 752 on the upper leg 700 and the upright inner wall 51 of the contoured cavity 50 which together limit the movement of the shaft 30. Thus, both these components work together to simulate the extent of movement in a live figure.

In the knee joint 170 in FIG. 8, the rotation-guard is in the form of a protrusion 752 that protrudes from a lower part of the upper leg 700 generally in the direction of the longitudinal axis of the shaft 30. In other words, in FIG. 8A, the shaft 30 points downwards, and so does the rotation guards in the form of the projection 752. This ensures that, at some stage in the rotation of the lower leg 800 the rotation guards in the form of the projection 752 will abut the lower leg 800L at some point in its rotational movement to prevent further rotation, thus performing its role as a rotation-guard.

Another example of a rotation-guard is seen in FIGS. 7A and 7B. In FIG. 7A, the extent of rotation of the shaft 30 within the contoured cavity 50 is limited by the side walls 51. However, in FIG. 7B, when the shaft 30 is resting on the lower inner wall 51, the rotation guards in the form of the projection 852 rests within a cut-away portion 52. Thus, in FIG. 7B, the stress in the ankle joint 180 is shared by the shaft 30 and the rotation guards in the form of the projection 852. This ensures that the shaft 30 is not required to bear the entire load.

In FIG. 7A, the rotation-guard, in the form of rotation guards in the form of the projection 852, protrudes from the lower end of the lower leg 800L. In this case, however, the rotation guards in the form of the projection 852 projects in a direction perpendicular to the longitudinal axis of the shaft 30.

Thus, the presence of rotation-guards in the knee 170 and ankle joints 180—which are most important for keeping stability in a standing toy—ensures that stresses in these joints are not borne solely by the narrow shafts 30. The overhanging portion 752 in the knee joint 170, in particular, is well suited for load bearing, since it is located in a thick portion of the upper leg 700, and can therefore withstand greater amounts of stress than would the narrower shaft 30.

It is advantageous that the rotation guards in the form of the overhanging portions 752 and 852 in FIGS. 4 and 7 respectively are integral and made of the same material as the body part from which each protrudes. For instance, the overhanging portion 752 is integral and made of the same material as upper leg 700L, while projection 852 is integral and made of the same material as lower leg portion 800L. This integrity of material ensures that the rotation-guards are stronger than if the rotation guard were to be an affixed component, since the joining of different materials may create a region of weakness, such as the affixed lips 82 in U.S. Pat. No. 4,790,789 (Mathis).

Another example of a rotation-guard is seen in FIGS. 11A and 11B. The extent of rotation of the forearm 400L is limited by the inner wall surfaces 51 of the contoured cavities 50. In FIG. 11A, the extent of rotation is also limited by the rotation guards in the form of the lower edge 352 of the upper arm 300. Thus, in FIG. 11A, the stress in the elbow joint 130, which derives from limiting the rotation of the forearm 400L, is shared by the combination of the upright inner wall 51 of the elbow joint 130L, and by the lower edge 352 of the upper arm 300L. Thus the location of the lower edge 352 is intentionally arranged and dimensioned so as to block the rotation of the forearm 400L.

In FIG. 11A, the extent of rotation has been limited to 90°, whereas in a human elbow the range of rotation is around 160°. However, realism in the elbow joint 130 is considered acceptable since, if the rotation guards in the form of the lower edge 352 were to be further distanced from the elbow joint 130L to provide greater rotation, the strength of the elbow joint 130L would be compromised.

In FIG. 11A, the rotation guards in the form of the overhanging portion 352 limits the upward movement of the forearm 400L, however, the forearm 400L is still free to rotate 360° around the shaft 30 of the elbow joint 130L, as seen in forearm 400L in FIG. 3A.

Figure 10D:
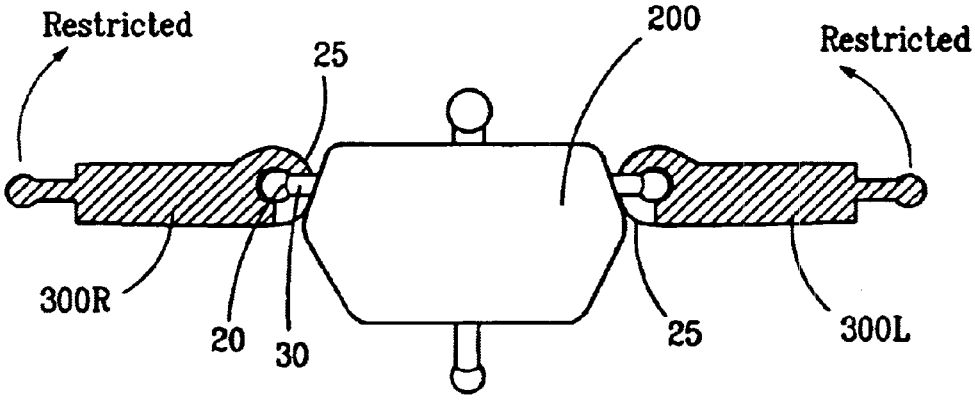

In FIG. 10, which illustrates the shoulder joints 120, there is no rotation-guard since the shoulder joints 120 have a considerable degree of rotation freedom, and there is no need to limit the rotation for this joint.

Ball Shaft Ratio

Figure 6A:
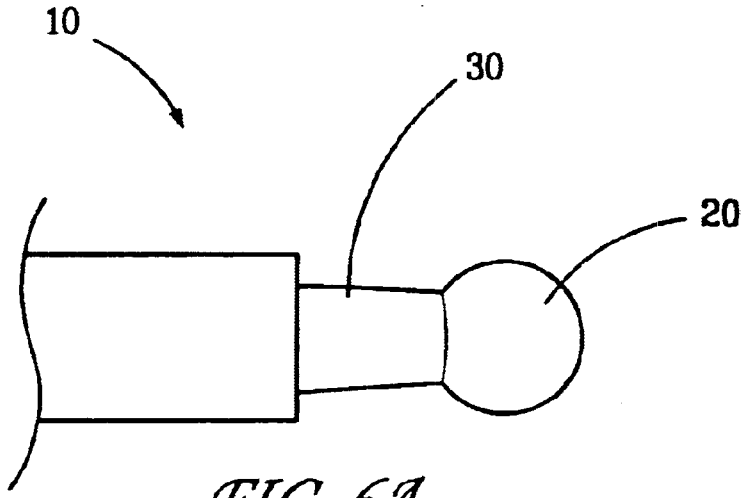
FIG. 6 illustrates the critical ratio of shaft diameter to ball diameter of the ball-socket joint arrangements used in the toy figure of FIG. 1 (the written description accurately describes the embodiment, and the drawing is given.
Figure 6B:
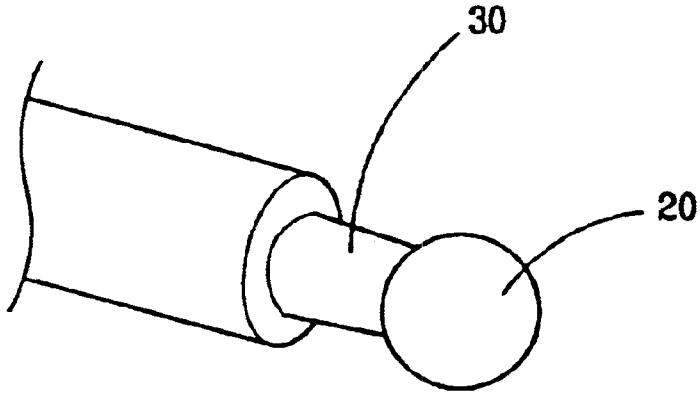

FIG. 6A shows a side view of a ball portion 10 comprising a ball 20 on a stem or shaft 30. FIG. 6B shows a perspective view of the same ball portion of FIG. 6A.

The ratio of the ball diameter to the shaft diameter is important in the present embodiment.

In order to achieve a miniaturized articulated toy figure, the ratio of the ball diameter to shaft diameter (also referred to as a knob diameter to stem diameter) should be around 1.36. In the example of FIG. 6, the diameter of the ball 20 is 3.4 mm while the diameter of the shaft 30 is 2.5 mm. Therefore, the ball diameter to shaft diameter ratio is 1.36.

In the drawings, the dimensions, and hence the ratio, may not be drawn to scale, but the intended ratio of ball diameter to shaft diameter is 1.36, which has been found to be critical to produce a miniaturized toy figure around 3 inches high.

This ratio of 1.36 is critical because, in a miniaturized toy around 3 inches high, a shaft diameter of much less than 2.5 mm would cause the shaft 30 to become susceptible to breakage. Furthermore, if the ball diameter were to be made much smaller than 3.4 mm, the range of movement of the limbs would be reduced, thus detracting from the life-likeness of the toy figure 1000.

Alternatively, if the ball diameter were increased while keeping the shaft diameter at 2.5 mm (i.e. larger ratio), the larger ball size would require the toy to have thicker limbs since the corresponding socket 40 is contained entirely within the body part. In other words, a larger ball diameter would require a larger socket 40, and hence a larger limb size.

Thus, a ball diameter to shaft diameter ratio of 1.36 is required to produce a life-like toy figure of around 3 inches in height, having life-like articulation of limbs.

Also, if the ball diameter becomes much larger than the shaft diameter, this would place excessive stress on the shaft 30, which could lead to greater tendency for failure.

High durability of the ball shaft is achieved by employing a critical ball to shaft ratio of 1.36, this ratio being relevant for toys sized 3 inch and above.

Interchangeability of Parts

In the ball-socket joints 25, the diameter of the balls 20 is slightly larger than the diameter of the socket 40. The balls 20 are snapped-fitted into the sockets 40. The socket opening deforms when the ball 20 is pushed into the socket 40 by virtue of the inherent resilience of the material, for example, solid acrylonitrile butadiene styrene (ABS) material which is used for the embodiment. In the prior art, the diameter of the ball is +0.2 mm larger than the socket. This size difference causes a degree of interference when the ball is snap-fitted. Where the interference is high, the ball will be very tightly fit in the socket, and the toy will lose its ease in manipulating the joints. The present embodiment uses a smaller degree of interference, where the ball diameter is around +0.05 mm to +0.08 mm greater than the socket diameter. Accordingly, a tight fit of the joints is achieved which maintains stability of posture, while the freedom of joint articulation is not compromised. In this way, the toy figure 1000 is able to adopt and maintain any arbitrary and manually manipulated posture for indefinite periods of time.

Balanceability

The design of the limbs takes into account the overall center of gravity of the toy in order to create a highly balanceable toy. This balanceability is achieved because of the even weight distribution of the toy figure 1000. The size and shape of the limbs are such that the legs are not significantly heavier in comparison with the other parts of the body. This weight distribution enables a degree of balanceability of the toy figure 1000 such that it is able to balance on any one limb, i.e. a one-hand-stand.

When the toy figure 1000 is standing on its feet 900, the above distribution of weight ensures a high degree of balanceability with a particularly low center of gravity. The toy figure 1000 is thus able to maintain a standing posture for considerable periods of time without overbalancing.

In the present embodiment, the ball portions 10 are built into or are part of the limb members. In other words, there is no need for a further component other than the adjoining limb parts. The fact that realistic articulation is achieved solely by parts found on the two adjoining limbs means that the external components are not required, such as the separate joints found in prior U.S. Pat. No. 6,033,284 (Rodriguez Ferre).

In the embodiment, since all of the balls 20 in the ball-socket joints 25 are of the same dimension, the user is able to interchange the various limbs, and to join any part to another body part, if the user so happens to desire to create a non-realistic figure.

In this specification, for the sake of ease of understanding, the words—upper, lower, front, rear, back, side, top, bottom, right, left, vertical, horizontal—each relate to the toy figure 1000 with reference to a body when it is upright, and are used in this manner even when the toy is not standing upright. In general, the terms are used in this specification in a similar manner as would be used to describe human body parts. Thus, for example, the terms upper arm and lower arm do not imply that the toy figure must necessarily be in an upright orientation.

The embodiment has been described with reference to a human-like toy, but other embodiments can relate to toys of animal-like or non-humanlike fantasy creatures.

The embodiments have been described by way of example only, and modifications are possible within the scope of the invention as defined by the appended claims.

The invention is restricted to addressing the need for creating an articulated toy, and addressing problems associated with miniaturization, and hence the invention has no relevance to applications outside the application of toy figures. Non-toy applications will thus not fall within the scope of the appended claims, which are limited to toy figures.

The toy figure 1000 is preferably made of a suitable plastic, but may also be made of wood, vinyl, ABS-20, metal, die-cast metal, PVC and other suitable material, provided that the material used for the ball-socket joints 25 provide sufficient grip.

The length and external shape/contours of the limbs can be modified, but experimentation would be required to ensure that overall balanceability is maintained. For instance, the toy could be given more muscles by having more rounded limbs.

The internal shape of the socket 40, the contoured cavity 50 and its side walls 51 might be modified within the scope of the invention. For instance, in the present embodiment, the internal surface of the socket 40 is completely and fully spherical. In other modifications, perhaps parts of the spherical regions might be removed or cut away, leaving sufficient parts of the spherical region remaining to provide the bare minimum function of the ball-socket joint 25. The form of cutting-away parts of the spherical inner region of the socket 40 might even add a degree of friction that is beneficial to the gripping of the ball 20 within the socket 40.

The socket 40 may be modified in other ways, provided that there remains at least the minimum amount of spherical surface portion required to provide the function of a ball-socket arrangement 25.

The surface of the ball 20 might be roughened to provide a greater degree of grip or friction between the ball 20 and the socket 40.

Some or all of the body parts may be made hollow or have holes drilled in them for visual effect.

Other variations can include non-human-like figures having more than four main limbs, or each main limb can have more than two parts, such as a multi-armed spider or fantasy creature. These modifications would still fall within the scope of the invention provided there is use of the features, particularly the ball-socket arrangements 25, defined in the appended claims.

In other modifications, the ball-socket joints 25 might not be snap fitted, but may be pre-assembled in a factory, and may not be disassembled by the user. These pre-assembled figures could include complex shapes and figures having a plurality of arms and joints.

The sockets 40 and the balls 20 in the embodiments are made of the same material, but other modifications may have the sockets 40 and balls 20 made of different materials. Thus, adjoining limbs may need to be made of different materials to take advantage of advantageous characteristics of different materials being used for the sockets 40 and balls 20.

The invention in its broadest aspect is not limited to the configurations shown in the diagrams. For instance, in modifications, the location of the ball portions 10 and the socket portions 15 might be swapped around compared to the diagrams. For instance, in the diagrams, the preferred embodiment has the shoulder joint 120 having a ball portion 10 projecting out of the upper torso 200, whereas in other modifications it is conceivable that the ball portion 10 may project from the end of the upper arm 300, with the socket 40 being in the upper torso portion 200.

In terms of the ball diameter to shaft diameter, it may be possible for competitors to produce toy figures with ratios slightly different from the preferred ratio of 1.36, provided that such modifications fall within the scope of the appended claims, although the ratio of 1.36 is much to be preferred when constructing a miniaturized toy figure of, say, about three inches high.

Toy figures less than three inches high may also incorporate the principles of the present invention particularly in terms of the construction of ball-socket joints 25.

Toy figures of greater than three inches may also be made, but the advantages of the present invention are particularly appreciated when constructing miniature toy figures, since the principles of the present invention are particularly suited to addressing one or more problems or technical difficulties associated with the construction of small scale toy figures.

What is claimed is:

1. An articulated toy figure comprising a plurality of body parts each operatively adapted to be adjoined one to another by a ball-socket joint arrangement, each ball-socket joint arrangement having a ball portion protruding from a region of a body part and also having a corresponding socket portion located in an adjoining body part, the ball portion having a knob supported on a shaft, the socket portion having a socket which rotatably receives the ball, wherein, in one or more of the ball-socket joint arrangements, the socket portion is provided with a contoured cavity arrangement having the socket in its interior, the contoured cavity arrangement limiting the extent of movement of the shaft therewithin, wherein, for one or more of the ball-socket joint arrangements, a rotation-guard is provided proximate the region of the body part from which the ball portion protrudes, the rotation-guard also limiting the extent of movement of the shaft within the contoured cavity arrangement, each contoured cavity arrangement and rotation-guard, individually or in combination comprising means for enabling the ball-socket joint arrangement to largely replicate the movement of such a joint in a corresponding live figure.

2. A toy figure of claim 1 wherein the rotation-guard comprises a protrusion of the body part from which the ball portion protrudes, the protrusion hindering the rotation of the adjoining body part.

3. A toy figure of claim 1 wherein the rotation-guard is integral and formed of the same material as the body part from which it protrudes.

4. A toy figure of claim 1 wherein the rotation-guard comprises a protrusion that protrudes from the body part generally in the direction of the longitudinal axis of the shaft.

5. A toy figure of claim 1 wherein one of the rotation guards is located at a joint which corresponds to a knee.

6. A toy figure of claim 1 wherein one of the rotation guards is located at a joint which corresponds to an ankle.

7. A toy figure of claim 1 wherein the contoured cavity arrangement includes contoured side wails which define the extent of movement of the shaft therewithin, the shaft being adapted to rotate within the confines of the side walls of the cavity arrangement.

8. A toy figure of claim 7 wherein, in one or more of the ball-socket joint arrangements, the side walls are non-symmetrical.

9. A toy figure of claim 7 wherein the side walls of the contoured cavity arrangement define an opening leading to the socket, the opening allowing movement of the shaft therein with a greater degree of freedom of movement in generally a first direction than in a second direction which is transverse to the first direction.

10. A toy figure of claim 1 the knob is detachably connectable to the corresponding socket portion.

11. A toy figure of claim 1 wherein, in the ball portion, the ratio of the ball diameter to the shaft diameter is around 1.36.

12. A toy figure of claim 1 wherein the toy figure when standing upright is around three inches high.

13. A toy figure of claim 1 wherein the ball diameter is 0.05 to 0.08 mm larger than the socket diameter to provide interference suitable for achieving longevity of stability in the articulations.

14. A toy figure of claim 1 wherein each of the legs of the toy figure has e lower and an upper limb, the lower limb being larger than the upper limb to enable to the center of gravity to be positioned closed to the lower portion of the overall leg.

15. A toy figure of claim 1 wherein each of the arms of the toy figure has a lower and upper limb, the lower limb being larger than the upper limb to enable to the center of gravity to be positioned closed to the lower portion of the overall arm.

16. A toy figure of claim 1 wherein the ankle of the toy figure has a ball portion wherein the shaft is arranged substantially perpendicular to the longitudinal axis of the lower leg part.

17. A toy figure of claim 1 wherein the ball portion protruding from the ankle is connected to the side of a body part corresponding to a foot.

18. A toy figure of claim 1 wherein the toy figure is provided with ball-socket joint arrangements In the ankle, knees, hips, torso, shoulders, elbows and neck.

19. A toy figure of claim 1 wherein the toy figure is provided with ball-socket joint arrangements in all of its joints.

20. A toy figure of claim 1 wherein the weight of the leg portions of the toy figure are substantially the same as the remaining parts of the figure to achieve a degree of balancealitity of the toy.

21. A toy figure of claim 1 wherein, in one or more of the ball-socket joint arrangements, the socket is located at one end of an elongated body part, the socket portion being adapted to receive the knob into the socket through an opening in a lateral side of the elongated body part.

22. A toy figure of claim 1 wherein the toy is human-like or animal-like.

23. A ball-socket joint arrangement operatively adapted to join a plurality of body part to form an articulated toy figure, the ball-socket joint arrangement having a ball portion protruding from a region of a body part and also having a corresponding socket portion located in an adjoining body part, the ball portion having a knob supported on a shaft, the socket portion having a socket which rotatably receives the knob, wherein, in one or more of the ball-socket joint arrangements, the socket portion is provided with a contoured cavity arrangement having the socket in its interior, the contoured cavity arrangement limiting the extent of movement of the shaft therewithin, wherein, for one or more of the ball-socket joint arrangements, a rotation-guard is provided proximate the region of the body part from which the ball portion protrudes, the rotation-guard also limiting the extent of movement of the shaft within the contoured cavity arrangement, each contoured cavity arrangement and rotation-guard, individually or in combination comprising means for enabling the ball-socket joint arrangement to largely replicate the movement of such a joint in a corresponding live figure.

* * * * *